US012471670B2

(12) United States Patent
Petrie et al.

(10) Patent No.: US 12,471,670 B2
(45) Date of Patent: Nov. 18, 2025

(54) SOLE STRUCTURE HAVING A FLUID-FILLED CHAMBER FOR AN ARTICLE OF FOOTWEAR

(71) Applicant: NIKE, Inc., Beaverton, OR (US)

(72) Inventors: Jason G. Petrie, Portland, OR (US); Gregory Scott, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 151 days.

(21) Appl. No.: 17/834,734

(22) Filed: Jun. 7, 2022

(65) Prior Publication Data

US 2022/0395058 A1 Dec. 15, 2022

Related U.S. Application Data

(60) Provisional application No. 63/209,822, filed on Jun. 11, 2021.

(51) Int. Cl.
*A43B 13/20* (2006.01)

(52) U.S. Cl.
CPC ..... *A43B 13/206* (2013.01); *A43B 13/20* (2013.01)

(58) Field of Classification Search
CPC ..... A43B 13/20; A43B 13/203; A43B 13/206
See application file for complete search history.

(56) References Cited

U.S. PATENT DOCUMENTS 4,223,457 A * 9/1980 Borgeas ..... A43B 13/189 36/35 B
5,595,004 A * 1/1997 Lyden ..... A43B 13/206 36/35 B
D396,342 S * 7/1998 Foxen ..... D2/961
9,801,428 B2 * 10/2017 Taylor ..... A43B 13/206
2003/0150133 A1 * 8/2003 Staffaroni ..... A43B 13/206 36/35 B
2010/0325914 A1 * 12/2010 Peyton ..... A43B 13/20 36/29
2011/0277346 A1 * 11/2011 Peyton ..... A43B 13/122 36/29
2015/0257481 A1 * 9/2015 Campos ..... A43B 13/189 36/103

(Continued)

FOREIGN PATENT DOCUMENTS

EP 0893074 A2 1/1999

OTHER PUBLICATIONS

European Patent Office (ISA), International Search Report and Written Opinion for PCT App. No. PCT/US2022/032857, mailed Aug. 31, 2022.

*Primary Examiner* — Katharine G Kane
(74) *Attorney, Agent, or Firm* — Honigman LLP; Matthew H. Szalach; Jonathan P. O'Brien

(57) ABSTRACT

A fluid-filled chamber includes a first barrier layer and a second barrier layer. The first barrier layer and the second barrier layer cooperating with each other to define an interior void that is asymmetric about a longitudinal axis of the fluid-filled chamber. The interior void includes a first thickness measured in a first direction between the first barrier layer and the second barrier layer at a perimeter region of the interior void and a second thickness measured in the first direction that is less than the first thickness at a central region of the interior void. The fluid-filled chamber further includes a tensile member disposed within the interior void and received within the central region.

18 Claims, 8 Drawing Sheets

(56) References Cited

U.S. PATENT DOCUMENTS

| | | | | |
|---|---|---|---|---|
| 2016/0075113 | A1* | 3/2016 | Chang | B32B 27/08 156/244.11 |
| 2017/0265564 | A1* | 9/2017 | Peyton | A43B 13/16 |
| 2017/0266938 | A1* | 9/2017 | Hensley | A43B 13/04 |
| 2018/0064207 | A1* | 3/2018 | Hurd | A43C 15/16 |
| 2018/0125160 | A1* | 5/2018 | Dojan | B29D 35/122 |
| 2018/0255871 | A1* | 9/2018 | Conway | B32B 7/12 |
| 2019/0261739 | A1* | 8/2019 | Taylor | A43B 13/206 |
| 2019/0365036 | A1 | 12/2019 | Meeker | |
| 2021/0145119 | A1 | 5/2021 | Campos, II et al. | |

* cited by examiner

SOLE STRUCTURE HAVING A FLUID-FILLED CHAMBER FOR AN ARTICLE OF FOOTWEAR

CROSS REFERENCE TO RELATED APPLICATIONS

This application claims priority under 35 U.S.C. § 119(e) to U.S. Provisional Application No. 63/209,822, filed on Jun. 11, 2021. The disclosure of this prior application is considered part of the disclosure of this application and is hereby incorporated by reference in its entirety.

FIELD

The present disclosure relates generally to sole structures for articles of footwear, and more particularly, to sole structures incorporating a fluid-filled chamber.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
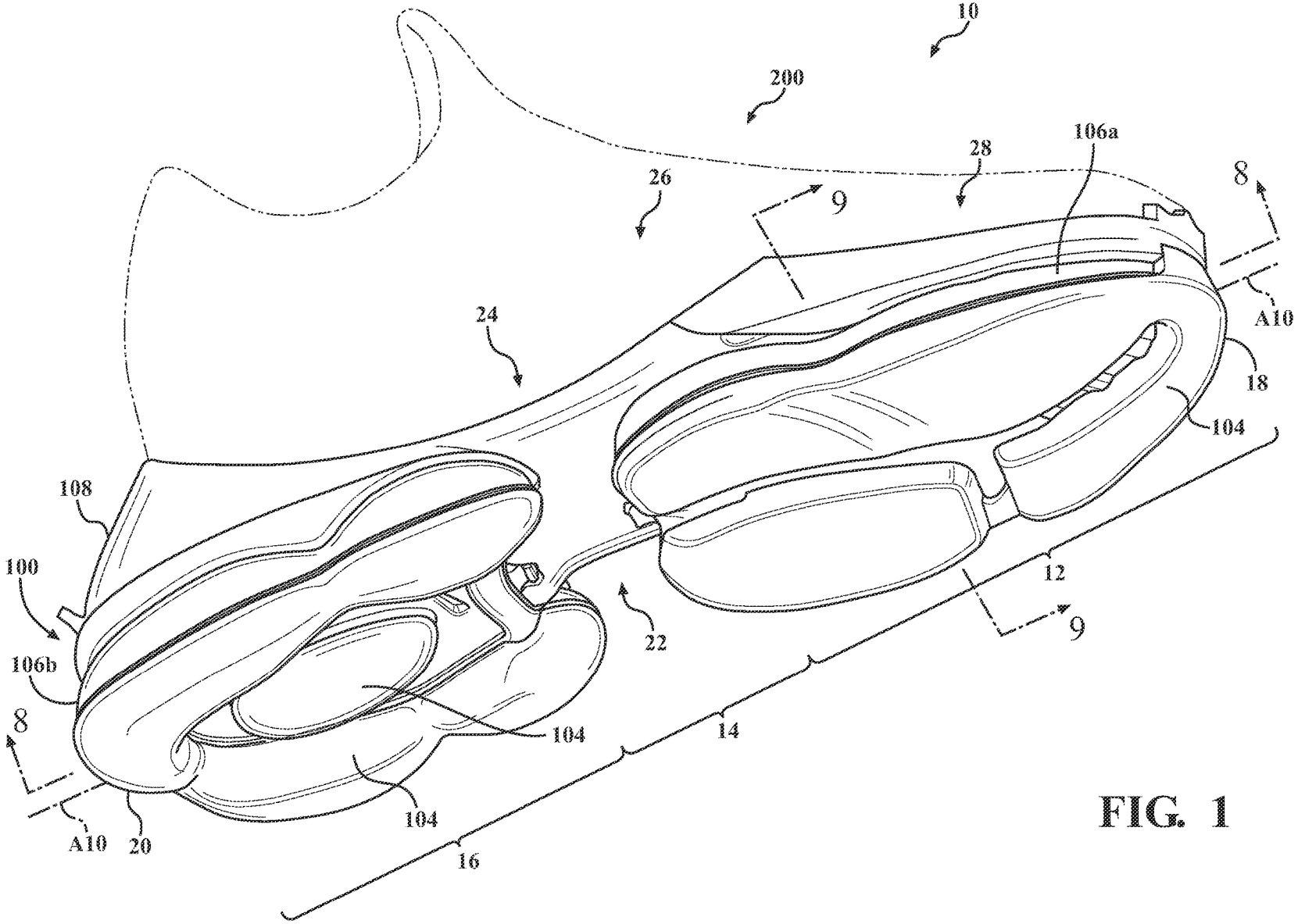
FIG. 1 is a perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a fluid-filled chamber. The fluid-filled chamber includes a first barrier layer and a second barrier layer. The second barrier layer cooperates with the first barrier layer to define an interior void. The interior void is asymmetric about a longitudinal axis of the fluid-filled chamber. A perimeter region of the interior void includes a first thickness measured in a first direction between the first barrier layer and the second barrier layer. A central region, bound by the perimeter region of the interior void, includes a second thickness measured in the first direction that is less than the first thickness at a central region of the interior void. A tensile member is disposed within the interior void and received within the central region.

Implementations of the disclosure may include one or more of the following optional features. In some implementations, the fluid-filled chamber includes at least two arcs disposed between the perimeter region and the central region. The arcs may be in fluid communication with the perimeter region and the central region. In another aspect, the arcs may be concentric with one another.

In some configurations, the perimeter region surrounds the central region and the two arcs. In one aspect, the perimeter region may be in fluid communication with the central region. The interior void may be pressurized.

In some configurations, the perimeter region includes a pair of medial lobes and a pair of lateral lobes. In one aspect, one of the pair of medial lobes has a thickness that may be greater than a thickness of the other of the pair of medial lobes and one of the pair of lateral lobes has a thickness may be greater than a thickness of the other of the pair of lateral lobes. An article of footwear may incorporate the fluid-filled chamber.

In another aspect of the disclosure, a bladder assembly is provided. The bladder assembly includes a first fluid-filled chamber and a second fluid-filled chamber. The first fluid-filled chamber includes a first barrier layer and a second barrier layer. The first barrier layer and the second barrier layer cooperate with each other to define an interior void that is asymmetric about a longitudinal axis of the first fluid-filled chamber.

The interior void including a first thickness measured in a first direction between the first barrier layer and the second barrier layer at a perimeter region of the interior void and a second thickness measured in the first direction that is less than the first thickness at a central region of the interior void. The first fluid-filled chamber further includes a tensile member disposed within the interior void and received within the central region. The second fluid-filled chamber includes a first barrier layer and a second barrier layer cooperating with the first barrier layer to define an interior void. The interior void includes a perimeter region bounding a web area. The web area bounds a central region.

In one implementation, the first fluid-filled chamber further includes at least two arcs disposed between the perimeter region and the central region of the first fluid-filled chamber. The at least two arcs may be in fluid communication with the perimeter region and the central region of the first fluid-filled chamber. In another aspect, the at least two arcs are concentric with one another.

In one implementation, the perimeter region of the first fluid-filled chamber surrounds the central region and the at least two arcs.

In one implementation the second fluid-filled chamber further includes a pair of medial lobes, a pair of lateral lobes and a posterior lobe fluidly connecting the pair of medial lobes to the pair of lateral lobes.

In one implementation, one of the pair of medial lobes of the second fluid-filled chamber is longer than the other of the pair of medial lobes of the second fluid-filled chamber, and one of the pair of lateral lobes of the second fluid-filled chamber is longer than the other of the pair of lateral lobes of the second fluid-filled chamber.

In one implementation, the pair of lateral lobes of the second fluid-filled chamber extends towards the first fluid-filled chamber to a greater extent than the pair of medial lobes.

In one implementation, the interior void of the first fluid-filled chamber and the second fluid-filled chamber is pressurized. An article of footwear may incorporate the bladder assembly.

Referring to FIGS. 1-9, an article of footwear 10 includes a sole structure 100 and an upper 200 attached to the sole structure 100. The article of footwear 10 may be divided into one or more regions. The regions may include a forefoot region 12, a mid-foot region 14, and a heel region 16. The forefoot region 12 may be further described as including a toe portion 12T corresponding to the phalanges of the foot, and a ball portion 12B corresponding to a metatarsophalangeal (MTP) joint. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis $A_{10}$ of the footwear 10 extends along a length of the footwear 10 from the anterior end 18 to the posterior end 20, and generally divides the footwear 10 into a medial side 22 and a lateral side 24, as shown in FIG. 1. Accordingly, the medial side 22 and the lateral side 24 respectively correspond with opposite sides of the footwear 10 and extend through the regions 12, 14, 16.

The article of footwear 10, and more particularly, the sole structure 100, may be further described as including an interior region 26 and a peripheral region 28, as indicated in FIG. 1. The peripheral region 28 is generally described as being a region between the interior region 26 and an outer perimeter of the sole structure 100. Particularly, the peripheral region 28 extends from the forefoot region 12 to the heel region 16 along each of the medial side 22 and the lateral side 24, and wraps around each of the forefoot region 12 and the heel region 16. Thus, the interior region 26 is circumscribed by the peripheral region 28, and extends from the forefoot region 12 to the heel region 16 along a central portion of the sole structure 100.

Figure 2:
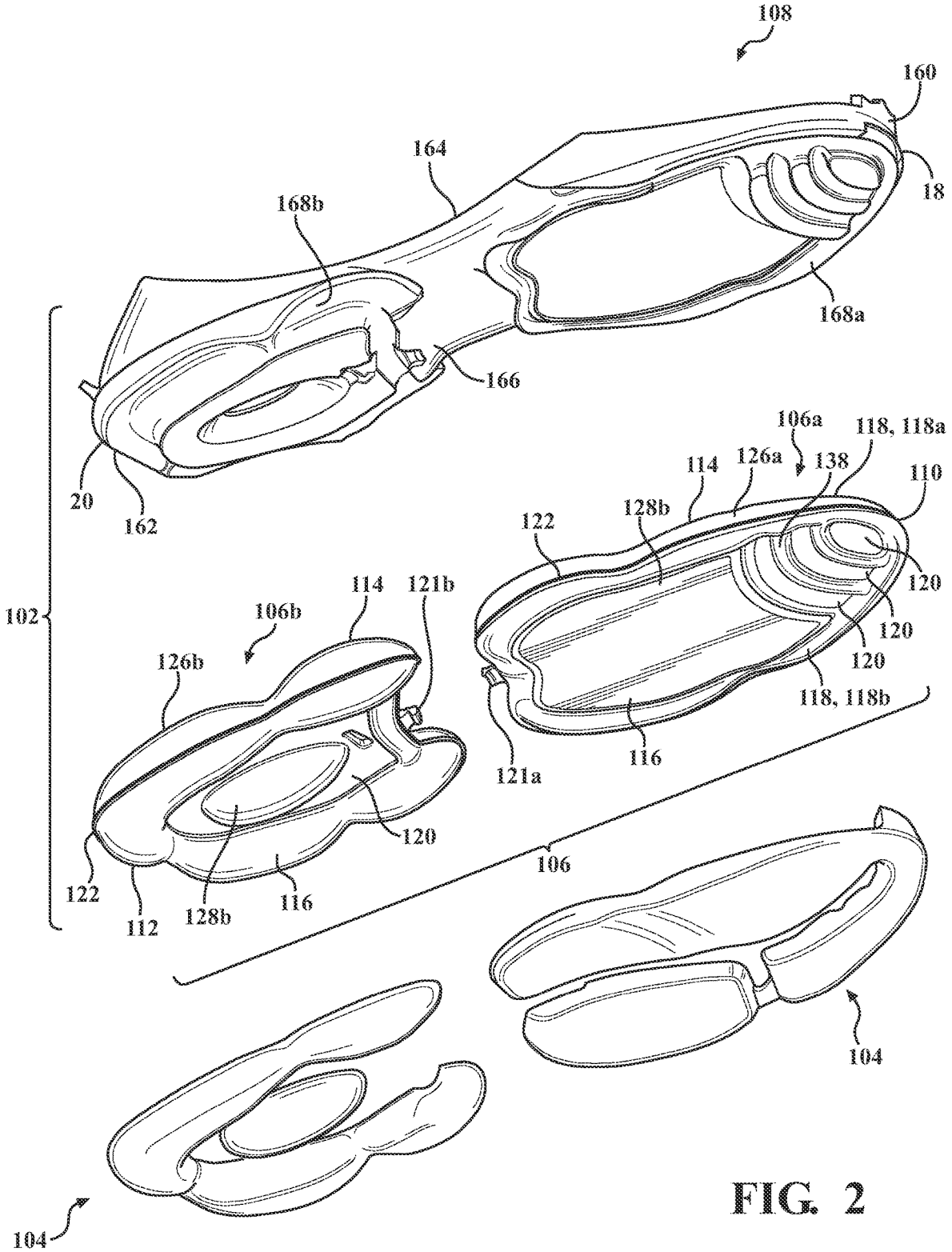
FIG. 2 is a bottom exploded view of a sole structure of the article of footwear of FIG. 1.
Figure 3:
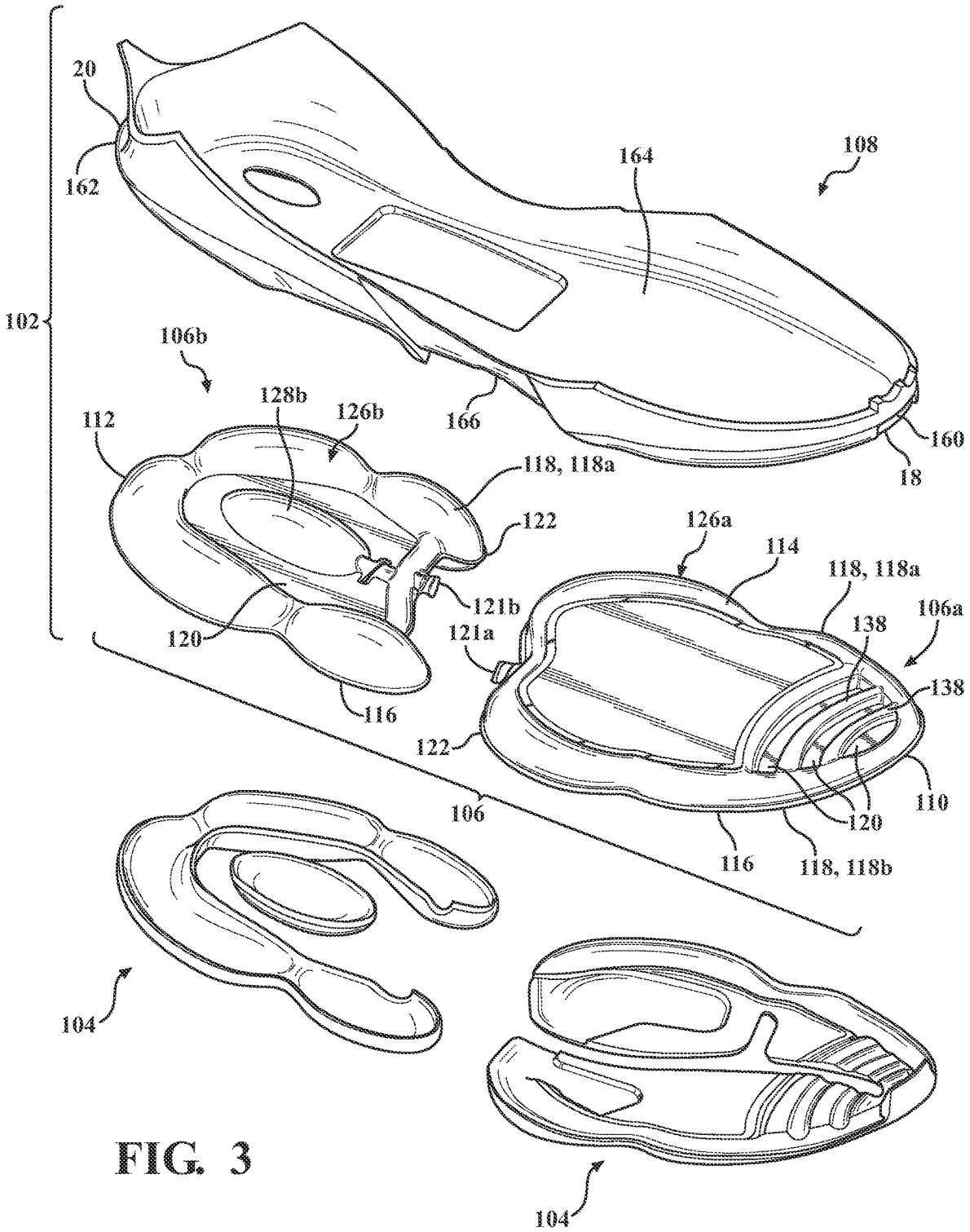
FIG. 3 is a top exploded view of the sole structure of FIG. 2.
Figure 4:
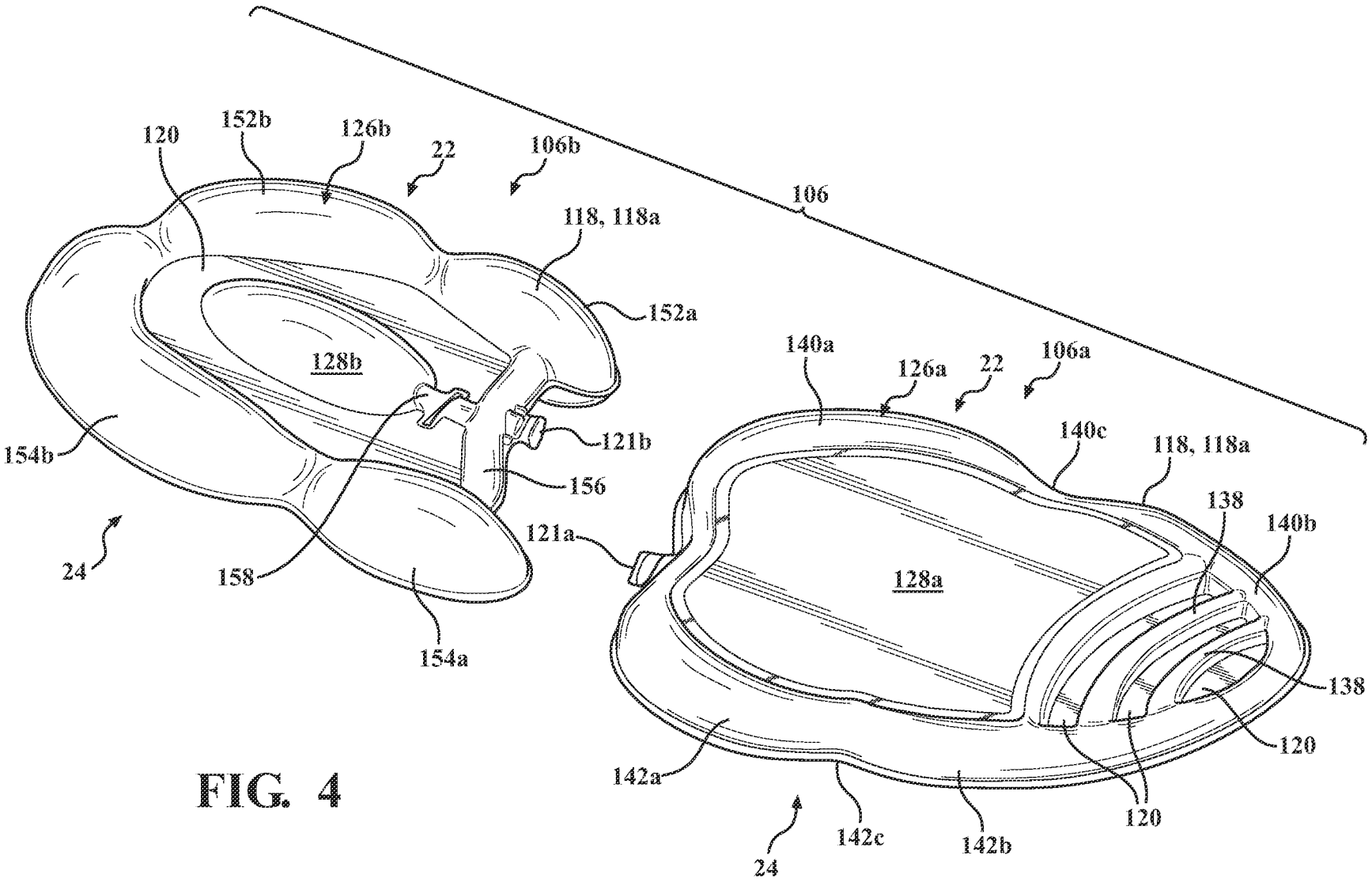
FIG. 4 is a top perspective view of a bladder assembly in accordance with the principles of the present disclosure for use with the article of footwear of FIG. 1.
Figure 5:
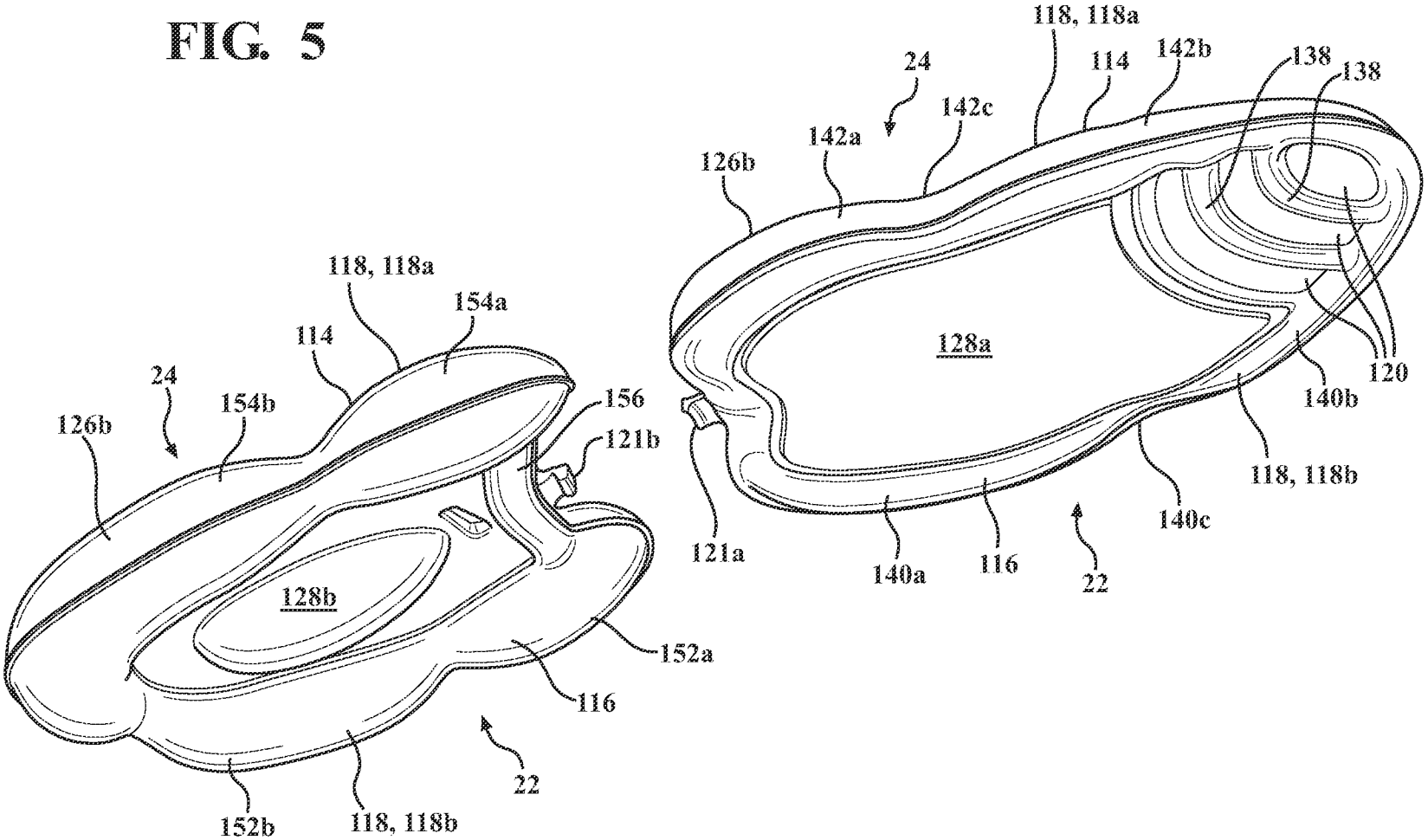
FIG. 5 is a bottom perspective view of a bladder assembly in accordance with the principles of the present disclosure for use with the article of footwear of FIG. 1.
Figure 6:
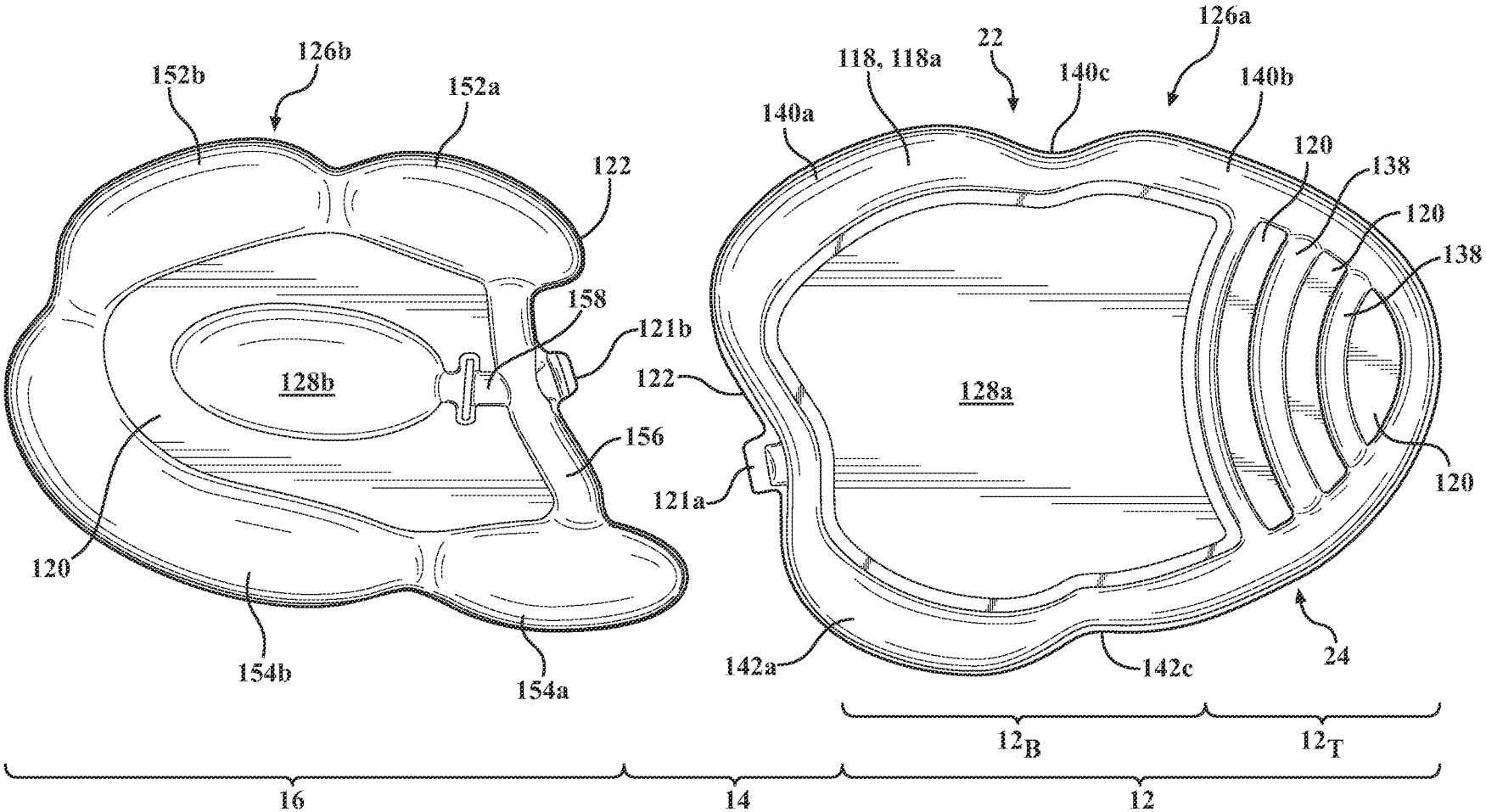
FIG. 6 is a top down view of a bladder assembly in accordance with the principles of the present disclosure for use with the article of footwear of FIG. 1.
Figure 7:
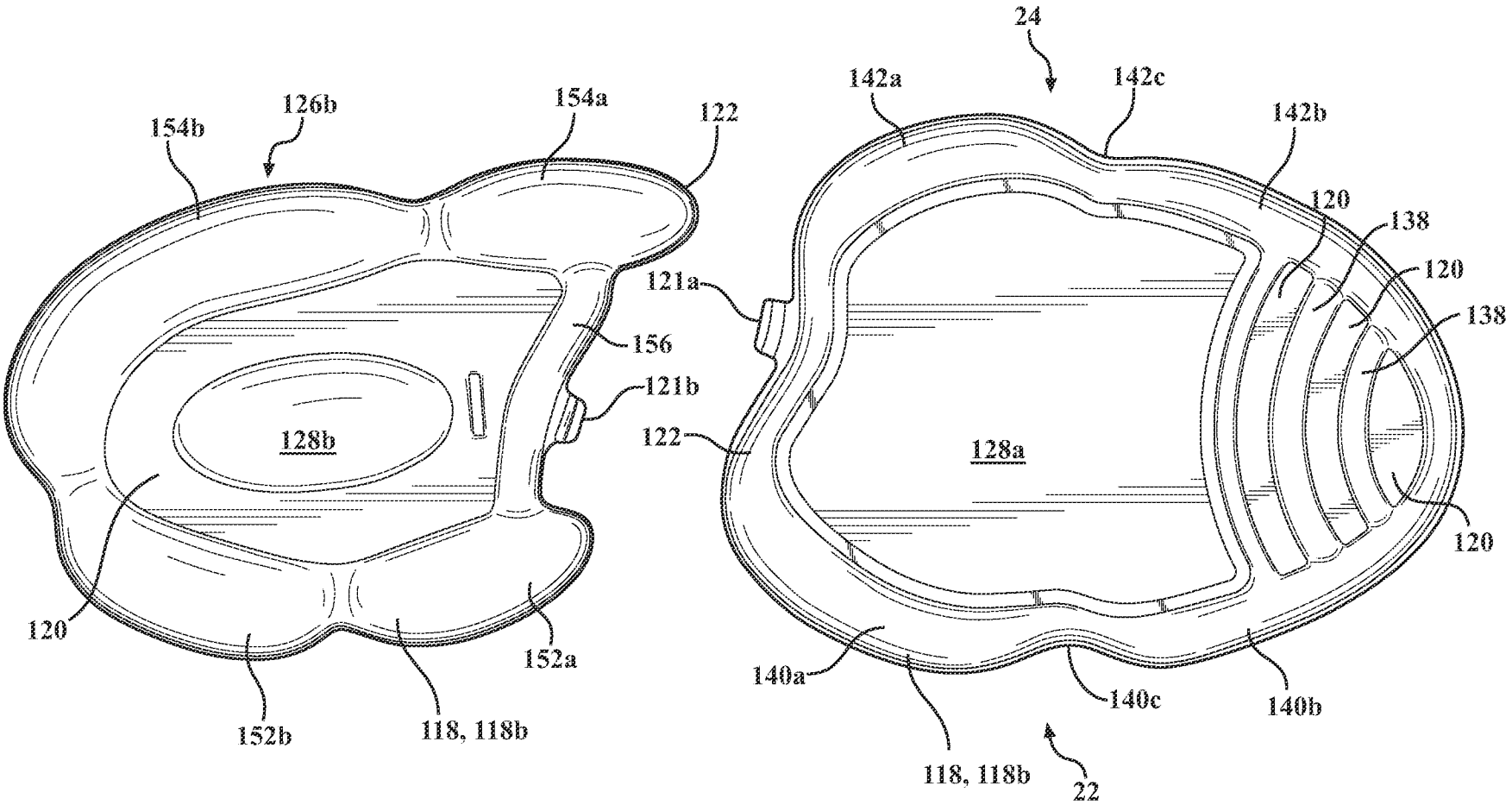
FIG. 7 is a bottom view of a bladder assembly in accordance with the principles of the present disclosure for use with the article of footwear of FIG. 1.

With reference to FIGS. 2 and 3, the sole structure 100 includes a midsole 102 configured to provide cushioning characteristics to the sole structure 100, and an outsole 104 configured to provide a ground-engaging surface of the article of footwear 10. Unlike conventional sole structures, the midsole 102 of the sole structure 100 may be formed compositely and include a plurality of subcomponents for providing desired forms of cushioning and support throughout the sole structure 100. For example, the midsole 102 includes a bladder assembly 106 and a chassis 108, where the chassis 108 is attached to the upper 200 and provides an interface between the upper 200 and the bladder assembly 106. The bladder assembly 106 may include a first fluid-filled chamber 106*a* and a second fluid-filled chamber 106*b*. The first fluid-filled chamber 106*a* is a separate structure from the second fluid-filled chamber 106*b* and is spaced apart from the second fluid-filled chamber 106*b* when assembled as midsole 102.

A longitudinal axis $A_{106}$ of the bladder assembly 106 extends from a first end 110 in the forefoot region 12 to a second end 112 in the heel region 16. The bladder assembly 106 may be further described as including a top surface or side 114 and a bottom surface or side 116 formed on an opposite side of the bladder assembly 106 from the top side 114. As discussed in greater detail below with respect to FIGS. 8 and 9, a thicknesses $T_{106}$ of the bladder assembly 106, or of elements of the bladder assembly 106, are defined by a distance from the top side 114 to the bottom side 116.

Figure 8:
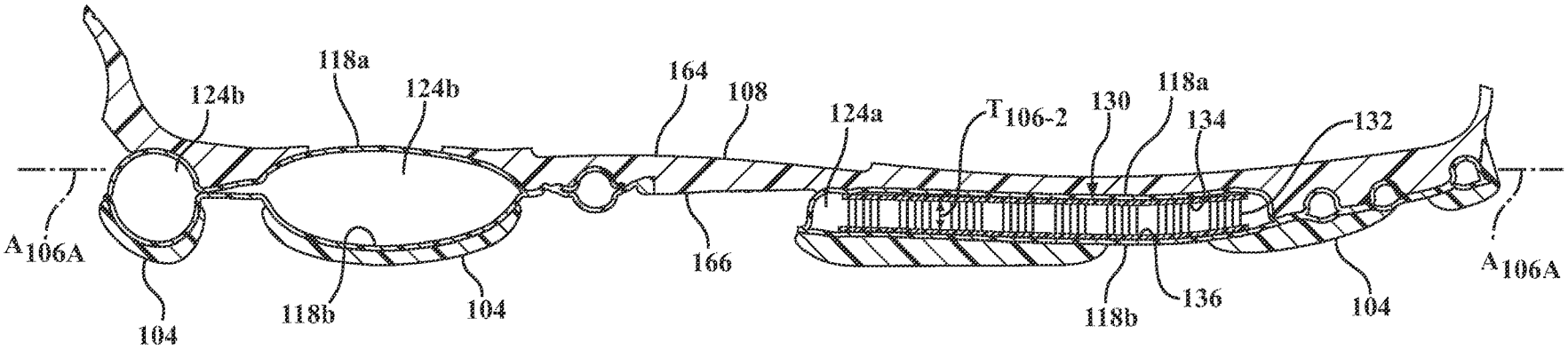
FIG. 8 is a partial cross-sectional view of the article of footwear taken along Line 8-8 of FIG. 1.
Figure 9:
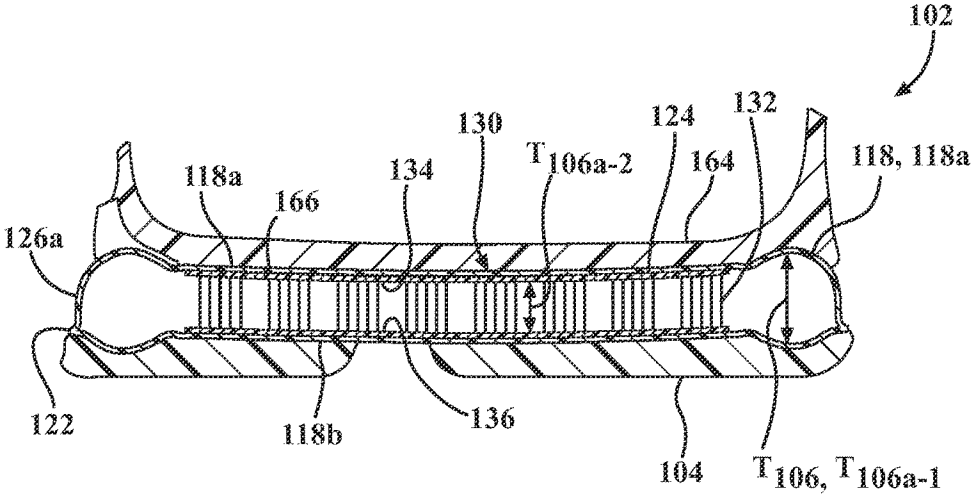
FIG. 9 is a cross-sectional view of the article of footwear taken along Line 9-9 of FIG. 1.

As shown in the cross-sectional view of FIGS. 8 and 9, the bladder assembly 106 may be formed by an opposing pair of barrier layers 118, which can be joined to each other at discrete locations to define an overall shape of the bladder assembly 106. Alternatively, the bladder assembly 106 can be produced from any suitable combination of one or more barrier layers 118. As used herein, the term "barrier layer" (e.g., barrier layers 118) encompasses both monolayer and multilayer films. In some configurations, one or both of the barrier layers 118 are each produced (e.g., thermoformed or blow molded) from a monolayer film (a single layer). In other configurations, one or both of the barrier layers 118 are each produced (e.g., thermoformed or blow molded) from a multilayer film (multiple sublayers). In either aspect, each layer or sublayer can have a film thickness ranging from about 0.2 micrometers to about 1 millimeter. In further configurations, the film thickness for each layer or sublayer can range from about 0.5 micrometers to about 500 micrometers. In yet further configurations, the film thickness for each layer or sublayer can range from about 1 micrometer to about 100 micrometers.

One or both of the barrier layers 118 can independently be transparent, translucent, and/or opaque. As used herein, the term "transparent" for a barrier layer and/or a bladder means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 118 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydron aphthal ene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some configurations, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials, as well as with the TPU copolymers described herein and optionally including combinations of polyimides and crystalline polymers, are also suitable.

The barrier layers 118 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entireties. In configurations where the barrier layers 118 include two or more sublayers, examples of suitable multilayer films include microlayer films, such as those disclosed in Bonk et al., U.S. Pat. No. 6,582,786, which is incorporated by reference in its entirety. In further configurations, the barrier layers 118 may each independently include alternating sublayers of one or more TPU copolymer materials and one or more EVOH copolymer materials, where the total number of sublayers in each of the barrier layers 118 includes at least four (4) sublayers, at least ten (10) sublayers, at least twenty (20) sublayers, at least forty (40) sublayers, and/or at least sixty (60) sublayers.

The bladder assembly 106 can be produced from the barrier layers 118 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 118 can be produced by co-extrusion followed by vacuum thermoforming to form the profile of the bladder assembly 106, which can optionally include one or more valves 121 (e.g., one way valves) that allows the fluid-filled chambers 106*a*, 106*b* of the bladder assembly 106 to be filled with the fluid (e.g., gas).

The fluid-filled chambers 106*a*, 106*b* of the bladder assembly 106 desirably have a low gas transmission rate to preserve its retained gas pressure. In some configurations, the fluid-filled chambers 106*a*, 106*b* have a gas transmission rate for nitrogen gas that is at least about ten (10) times lower than a nitrogen gas transmission rate for a butyl rubber layer of substantially the same dimensions. In one aspect, fluid-filled chambers 106*a*, 106*b* have a nitrogen gas transmission rate of 15 cubic-centimeter/square-meter·atmosphere·day ($cm^3/m^2$·atm·day) or less for an average film thickness of 500 micrometers (based on thicknesses of barrier layers 118). In further aspects, the transmission rate is 10 $cm^3/m^2$·atm·day or less, 5 $cm^3/m^2$·atm·day or less, or 1 $cm^3/m^2$·atm·day or less.

In the shown configuration, the barrier layers 118 include a first, upper barrier layer 118*a* forming the top side 114 of the fluid-filled chambers 106*a*, 106*b*, and a second, lower barrier layer 118*b* forming the bottom side 116 of the fluid-filled chambers 106*a*, 106*b*. In the illustrated example, interior, opposing surfaces (i.e. facing each other) of the barrier layers 118 are joined together at discrete locations to form a web area 120 and a peripheral seam 122. The peripheral seam 122 extends around the outer periphery of the respective fluid-filled chambers 106*a*, 106*b* and defines an outer peripheral profile of the fluid-filled chambers 106*a*, 106*b*.

The fluid-filled chambers 106*a*, 106*b* may be referenced as a first fluid-filled chamber 106*a* and a second fluid-filled chamber 106*b*. The first fluid-filled chamber 106*a* is configured to be disposed in the forefoot region 12 and the second fluid-filled chamber 106*b* is configured to be disposed in the heel region 16. As discussed above, the first barrier layer 118*a* cooperates with the second barrier layer 118*b* to define an interior void 124*a*, 124*b*.

With reference first to the first fluid-filled chamber 106*a*, the interior void 124*a* is asymmetric about a longitudinal axis $A_{106a}$ of the first fluid-filled chamber 106*a*. A perimeter region 126*a* of the interior void 124*a* includes a first thickness $T_{106a-1}$ measured in a first direction between the first barrier layer 118*a* and the second barrier layer 118*b*, as shown in FIGS. 8 and 9. A central region 128*a*, bound by the perimeter region 126*a* of the interior void 124*a* includes a second thickness $T_{106a-2}$ measured in the first direction that is less than the first thickness $T_{106a-1}$ at the perimeter region 126*a* of the interior void 124*a*.

A tensile member 130 is disposed within the interior void 124*a* and received within the central region 128*a*. Each tensile element 130 may include a series of tensile strands 132 extending between an upper tensile sheet 134 and a lower tensile sheet 136. The upper tensile sheet 134 may be attached to the first barrier layer 118*a* while the lower tensile sheet 136 may be attached to the second barrier layer 118*b*. In this manner, when the first fluid-filled chamber 106*a* receives a pressurized fluid, the tensile strands 132 of the tensile member 130 are placed in tension. Because the upper tensile sheet 134 is attached to the first barrier layer 118*a* and the lower tensile sheet 136 is attached to the second barrier layer 118*b*, the tensile strands 132 retain a desired shape of the first fluid-filled chamber 106*a* when the pressurized fluid is injected into the interior void 124*a*. Additional details of tensile member 130 are described in U.S. Pat. Nos. 4,906,502, 5,083,361, and 6,385,864, the disclosures of which are fully incorporated herein by reference. Alternatively, a foam structure, not shown, may be disposed within the interior void 124*a*.

With reference now to FIGS. 4-7, the first fluid-filled chamber 106*a* may further include an arc 138. In particular, the fluid-filled chamber 106*a* may include at least two arcs 138 disposed between the perimeter region 126*a* and the central region 128*a*. The arcs 138 are spaced apart from each other by the web area 120 and are disposed on the anterior portion of the first fluid filled chamber 106*a*. The arcs 138 may be in fluid communication with the perimeter region 126*a* and the central region 128*a*. Alternatively, the arcs 138 may be sealed from the perimeter region 126*a* and the central region 128*a*. In another aspect, the arcs 138 may be concentric with one another. The arcs 138 are illustratively shown as having a constant radius. However, it should be appreciated that the arcs may be configured to having a varying radius.

In some configurations, the perimeter region 126*a* surrounds the central region 128*a* and the two arcs 138. The perimeter region 126*a* may be in fluid communication with the central region 128*a* so as to allow for a load to be balanced between the central region 128*a* and the perimeter region 126*a*. As described above, the first fluid-filled chamber 106*a* may include a valve 121*a* that allows the fluid-filled chamber 106*a* to be filled with the fluid (e.g., gas) such that the interior void 124*a* is pressurized.

In some configurations, the perimeter region 126*a* includes a pair of medial lobes 140*a*, 140*b* and a pair of lateral lobes 142*a*, 142*b*. The medial lobes 140*a*, 140*b* extend along a medial side 22 of the first fluid-filled chamber 106*a*. The medial lobes 140*a*, 140*b* may be referenced as a first medial lobe 140*a* and a second medial lobe 140*b*. The first medial lobe 140*a* is arranged in series with the second medial lobe 140*b*. In one aspect, the first medial lobe 140*a* has a thickness and a width that may be greater than a thickness and a width of the second medial lobe 140*b*. As such, the first medial lobe 140*a* is more bulbous than the second medial lobe 140*b*.

The lateral lobes 142*a*, 142*b* may be referenced as a first lateral lobe 142*a* and a second lateral lobe 142*b*. The first lateral lobe 142*a* is arranged in series with the second lateral lobe 142*b*. In one aspect, the first lateral lobe 142*a* has a thickness and a width that may be greater than a thickness and a width of second lateral lobe 142*b*. As such, the first lateral lobe 142*a* is more bulbous than the second lateral lobe 142*b*.

The first medial lobe 140*a* is contiguous with the first lateral lobe 142*a*. In particular, a first end of the first medial lobe 140*a* is seamlessly coupled with a first end of the first lateral lobe 142*a*. A second end of the first medial lobe 140*a* is seamlessly coupled with a first end of the second medial lobe 140*b*. A second end of the second medial lobe 140*b* is seamlessly coupled to a second end of the second lateral lobe 142*b*. A first end of the second lateral lobe 142*b* is seamlessly coupled to a second end of the first lateral lobe 142*a*.

In one aspect, the first and the second ends of the respective medial lobes 140*a*, 140*b* and the lateral lobes 142*a*, 142*b* are smaller, in three dimensions, than a center of the respective medial lobes 140*a*, 140*b* and the lateral lobes 142*a*, 142*b*. As such, each of the respective medial lobes 140*a*, 140*b* and the lateral lobes 142*a*, 142*b* have a generally bulbous shape.

The first medial lobe 140*a* and the first lateral lobe 142*a* are generally C-shaped. A valve 121*a* may be disposed where the first end of the first medial lobe 140*a* and the first end of the first lateral lobe 142*a* are joined. The second medial lobe 140*b* and the second lateral lobe 142*b* are also C-shaped. The first fluid-filled chamber 106*a* includes a pair of neck portions 140*c*, 142*c* where the second end of the first medial lobe 140*a* is joined to the first end of the second medial lobe 140*b* and the second end of the first lateral lobe 142*a* is joined to the first end of the second lateral lobe 142*b*. The neck portions 140*c*, 142*c* have a cross-section smaller than the cross-section of the mid-portion of the first medial lobe 140*a*, second medial lobe 140*b*, first lateral lobe 140*b*, and second lateral lobe 142*b*. Collectively, the first medial lobe 140*a*, the second medial lobe 140*b*, the first lateral lobe 142*a*, and the second lateral lobe 142*b* form a generally heart shaped structure.

With reference again to FIGS. 2-7, a description of the second fluid-filled chamber 106*b* of the bladder assembly 106 is now provided. The second fluid-filled chamber 106*b* is configured to be disposed in the heel region 16. The perimeter region 126*b* bounds a periphery of the second fluid-filled chamber 106*b* and bounds the central region 128*b*. The web area 120 bounds the central region 128*b*. The interior void 124*b* of the central region 128*b* may be separated from the interior void 124*b* of the perimeter region 126*b* by the web area 120 wherein the first barrier layer 118*a* and the second barrier layer 118*b* are adhered to each other. Alternatively, the first barrier layer 118*a* and the second barrier layer 118*b* may be spaced apart at the web area 120 so as to fluidly connect the perimeter region 126*b* to the central region 128*b*. The central region 128*b* is a bulbous member that projects both upwardly and downwardly from opposite sides of the web area 120.

In some configurations, the perimeter region 126*b* surrounds the central region 128*b*. The perimeter region 126*b* includes a pair of medial lobes 152*a*, 152*b* and a pair of lateral lobes 154*a*, 154*b*. The pair of lateral lobes 154*a*, 154*b* extends towards the first fluid-filled chamber 106*a* to a greater extent than the pair of medial lobes 152*a*, 152*b*. The medial lobes 152*a*, 152*b* extend along a medial side 22 of the second fluid-filled chamber 106*b*. The medial lobes 152*a*, 152*b* may be referenced as a first medial lobe 152*a* and a second medial lobe 152*b*. The first medial lobe 152*a* is arranged in series with the second medial lobe 152*b*. In one aspect, the first medial lobe 152*a* has a length which is shorter than a length of the second medial lobe 152*b*. The first medial lobe 140*a* and the second medial lobe 140*b* are bulbous structures seamlessly connected to each other.

The lateral lobes 154*a*, 154*b* may be referenced as a first lateral lobe 154*a* and a second lateral lobe 154*b*. The first lateral lobe 154*a* is arranged in series with the second lateral lobe 154*b*. In one aspect, the first lateral lobe 154*a* has length shorter than a length of the second lateral lobe 154*b*. The first lateral lobe 154*a* and the second lateral lobe 154*b* have a bulbous shape. The second lateral lobe 154*b* extends into a posterior portion of the heel region 16, so as to have a length greater than the length of the second medial lobe 152*b* of the second fluid-filled chamber 106*b*.

The first medial lobe 152*a* is fluidly connected with the first lateral lobe 154*a* via a posterior lobe 156. The posterior lobe 156 has a generally uniform diameter. For illustrative purposes, the posterior lobe 156 is connected at an intermediate portion of the first medial lobe 152*a* and the first lateral lobe 154*a*. However, it should be appreciated that the posterior lobe 156 may be connected to a first end of the first medial lobe 152*a* and the first lateral lobe 154*a*. A second end of the first medial lobe 152*a* is seamlessly coupled with a first end of the second medial lobe 152*b*. A second end of the second medial lobe 152*b* is seamlessly coupled to a second end of the second lateral lobe 154*b*. A first end of the second lateral lobe 154*b* is seamlessly coupled to a second end of the first lateral lobe 154*a*.

In one aspect the first and the second ends of the respective medial lobes 152*a*, 152*b* and the lateral lobes 154*a*, 154*b* are smaller, in three dimensions, than a center of the respective medial lobes 152*a*, 152*b* and the lateral lobes 154*a*, 154*b*. As such, each of the respective medial lobes 152*a*, 152*b* and the lateral lobes 154*a*, 154*b* have a generally elongated and bulbous shape.

As described above, the second fluid-filled chamber 106*a* may include a valve 121*b* that allows the second fluid-filled chamber 106*b* of the bladder assembly 106 to be filled with the fluid (e.g., gas) such that the interior void 124*b* is pressurized. The second fluid-filled chamber 106*b* may further include a conduit 158 connecting the central region 128*b* to the perimeter region 126*b*. The valve 121*b* is configured to supply the fluid to both the central region 128*b* and the perimeter region 126*b*.

With reference again to FIGS. 2 and 3, the chassis 108 is configured to interface with the bladder assembly 106 to provide a unitary midsole 102. The chassis 108 extends from a first end 160 at the anterior end 18 of the sole structure 100 to a second end 162 at the posterior end 20 of the sole structure 100. The chassis 108 further includes a top surface 164 defining a portion of a footbed, and a bottom surface 166 formed on the opposite side of the chassis 108 than the top surface 164 and configured to interface with the top side 114 of the bladder assembly 106.

The chassis 108 includes a plurality of grooves 168*a*, 168*b* formed on the bottom surface 166. Here, a shape each of the grooves 168*a*, 168*b* corresponds to a shape of a corresponding perimeter region 126*a*, 126*b* and central region 128*a*, 128*b*, such that when the chassis 108 is assembled with the bladder assembly 106, the perimeter region 126*a*, 126*b* and central region 128*a*, 128*b* are seated to the bottom surface 166 of the chassis 108. In the illustrated example, the perimeter region 128*a*, 128*b* are configured to fully extend into the grooves 168*a*, 168*b* when the midsole 102 is assembled.

The chassis 108 may be formed of a resilient polymeric material, such as foam or rubber, to impart properties of cushioning, responsiveness, and energy distribution to the foot of the wearer. The chassis 108 may independently be formed from a single unitary piece of resilient polymeric material, or may be formed of a plurality of elements each formed of one or more resilient polymeric materials. For example, the plurality of elements may be affixed to each other using a fusing process, using an adhesive, or by suspending the elements in a different resilient polymeric material. Alternatively, the plurality of elements may not be affixed to each other, but may remain independent while contained in one or more structures forming the cushioning element. In this alternative example, the plurality of independent cushioning elements may be a plurality of foamed particles, and may contained in a bladder or shell structure. As such, the cushioning element may be formed of a plurality of foamed particles contained within a relatively translucent bladder or shell formed of a film such as a barrier membrane.

Example resilient polymeric materials for the chassis may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Examples of suitable polyurethanes include those discussed above for barrier layers 118. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some configurations, the foamed polymeric material may be a crosslinked foamed material. In these configurations, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

In some examples, the outsole 104 extends over the midsole 102 to provide increased durability and resiliency. In the illustrated example, the outsole 104 is provided as a polymeric layer that is overmolded onto the bladder assembly 106 to provide increased durability to the exposed portions of the lower barrier layer 118*b* of the bladder assembly 106. Accordingly, the outsole 104 is formed of a different material than the bladder assembly 106, and includes at least one of a different thickness, a different hardness, and a different abrasion resistance than the lower barrier layer 118*b*. In some examples, the outsole 104 may be formed integrally with the lower barrier layer 118*b* of the bladder assembly 106 using an overmolding process. In other examples, the outsole 104 may be formed separately from the lower barrier layer 118*b* of the bladder assembly 106 and may be adhesively bonded to the lower barrier layer 118*b*.

The upper 200 is attached to the sole structure 100 and includes interior surfaces that define an interior void configured to receive and secure a foot for support on sole structure 100. The upper 200 may be formed from one or more materials that are stitched or adhesively bonded together to form the interior void. Suitable materials of the upper may include, but are not limited to, mesh, textiles, foam, leather, and synthetic leather. The materials may be selected and located to impart properties of durability, air-permeability, wear-resistance, flexibility, and comfort.

Clause 1. A fluid-filled chamber including a first barrier layer and a second barrier layer cooperating with the first barrier layer to define an interior void. The interior void is asymmetric about a longitudinal axis of the fluid-filled chamber. The interior void includes a first thickness measured in a first direction between the first barrier layer and the second barrier layer at a perimeter region of the interior void and a second thickness measured in the first direction that is less than the first thickness at a central region of the interior void. The fluid-filled chamber further includes a tensile member disposed within the interior void and received within the central region.

The following Clauses provide exemplary configurations of the fluid-filled chamber described above.

Clause 2. The fluid-filled chamber of Clause 1, further including at least two arcs disposed between the perimeter region and the central region.

Clause 3. The fluid-filled chamber of Clause 2, wherein the at least two arcs are in fluid communication with the perimeter region and the central region.

Clause 4. The fluid-filled chamber of Clause 2, wherein the at least two arcs are concentric with one another.

Clause 5. The fluid-filled chamber of Clause 2, wherein the perimeter region surrounds the central region and the at least two arcs.

Clause 6. The fluid-filled chamber of Clause 1, wherein the perimeter region surrounds the central region.

Clause 7. The fluid-filled chamber of any of Clause 1, wherein the perimeter region is in fluid communication with the central region.

Clause 8. The fluid-filled chamber of Clause 1, wherein the interior void is pressurized.

Clause 9. The fluid-filled chamber of Clause 1, wherein the perimeter region includes a pair of medial lobes and a pair of lateral lobes.

Clause 10. The fluid-filled chamber of Clause 9, wherein one of the pair of medial lobes has a thickness that is greater than a thickness of the other of the pair of medial lobes and wherein one of the pair of lateral lobes has a thickness that is greater than a thickness of the other of the pair of lateral lobes.

Clause 11. An article of footwear incorporating the fluid-filled chamber of any of the preceding Clauses.

Clause 12. A bladder assembly including a first fluid-filled chamber and a second fluid-filled chamber. The first fluid-filled chamber includes a first barrier layer and a second barrier layer. The first barrier layer and the second barrier layer cooperating with each other to define an interior void that is asymmetric about a longitudinal axis of the first fluid-filled chamber. The interior void including a first thickness measured in a first direction between the first barrier layer and the second barrier layer at a perimeter region of the interior void and a second thickness measured in the first direction that is less than the first thickness at a central region of the interior void. The first fluid-filled chamber further includes a tensile member disposed within the interior void and received within the central region. The second fluid-filled chamber includes a first barrier layer and a second barrier layer cooperating with the first barrier layer to define an interior void, the interior void including a perimeter region bounding a web area, the web area bounding a central region.

Clause 13. The bladder assembly of Clause 12, wherein the first fluid-filled chamber further includes at least two arcs disposed between the perimeter region and the central region of the first fluid-filled chamber.

Clause 14. The bladder assembly of Clause 13, wherein the at least two arcs are in fluid communication with the perimeter region and the central region of the first fluid-filled chamber.

Clause 15. The bladder assembly of Clause 14, wherein the at least two arcs are concentric with one another.

Clause 16. The bladder assembly of Clause 13, wherein the perimeter region surrounds the central region and the at least two arcs.

Clause 17. The bladder assembly of Clause 11, wherein the second fluid-filled chamber further includes a pair of medial lobes, a pair of lateral lobes and a poster lobe fluidly connecting the pair of medial lobes to the pair of lateral lobes.

Clause 18. The bladder assembly of Clause 17, wherein the one of the pair of medial lobes of the second fluid-filled chamber is longer than the other of the pair of medial lobes of the second fluid-filled chamber, and wherein one of the pair of lateral lobes of the second fluid-filled chamber is longer than the other of the pair of lateral lobes of the second fluid-filled chamber.

Clause 19. The bladder assembly of Clause 17, wherein the pair of lateral lobes of the second fluid-filled chamber extends towards the first fluid-filled chamber to a greater extent than the pair of medial lobes.

Clause 20. The bladder assembly of Clause 11, wherein the interior void of the first fluid-filled chamber and the second fluid-filled chamber is pressurized.

Clause 21. An article of footwear incorporating the bladder assembly of any of the preceding Clauses 11-19.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A fluid-filled chamber comprising:

a first barrier layer;

a second barrier layer cooperating with the first barrier layer to define an interior void that is asymmetric about a longitudinal axis of the fluid-filled chamber, the interior void including a first thickness measured in a first direction between the first barrier layer and the second barrier layer at a perimeter region of the interior void and a second thickness measured in the first direction that is less than the first thickness at a central region of the interior void;

a tensile member disposed within the interior void and received within the central region; and at least two arcs disposed in an anterior region of the fluid-filled chamber and extending continuously from and between a medial side of the fluid-filled chamber and a lateral side of the fluid-filled chamber and disposed between the perimeter region of the interior void and the central region of the interior void, the at least two arcs being nested relative to one another.

2. The fluid-filled chamber of claim 1, wherein the at least two arcs are in fluid communication with the perimeter region and the central region.

3. The fluid-filled chamber of claim 1, wherein the at least two arcs are concentric with one another.

4. The fluid-filled chamber of claim 1, wherein the perimeter region surrounds the central region and the at least two arcs.

5. The fluid-filled chamber of claim 1, wherein the perimeter region surrounds the central region.

6. The fluid-filled chamber of claim 1, wherein the perimeter region is in fluid communication with the central region.

7. The fluid-filled chamber of claim 1, wherein the interior void is pressurized.

8. The fluid-filled chamber of claim 1, wherein the perimeter region includes a pair of medial lobes and a pair of lateral lobes.

9. The fluid-filled chamber of claim 8, wherein one of the pair of medial lobes has a thickness that is greater than a thickness of the other of the pair of medial lobes and wherein one of the pair of lateral lobes has a thickness that is greater than a thickness of the other of the pair of lateral lobes.

10. An article of footwear incorporating the fluid-filled chamber of claim 1.

11. A bladder assembly comprising:

a first fluid-filled chamber and a second fluid-filled chamber, wherein the first fluid-filled chamber includes:

a first barrier layer;

a second barrier layer cooperating with the first barrier layer to define an interior void that is asymmetric about a longitudinal axis of the first fluid-filled chamber, the interior void including a first thickness measured in a first direction between the first barrier layer and the second barrier layer at a perimeter region of the interior void and a second thickness measured in the first direction that is less than the first thickness at a central region of the interior void;

a tensile member disposed within the interior void and received within the central region; and at least two arcs disposed in an anterior region of the first fluid-filled chamber and extending continuously from and between a medial side of the first fluid-filled chamber and a lateral side of the first fluid-filled chamber and disposed between the perimeter region and the central region of the first fluid-filled chamber, the at least two arcs being nested relative to one another; and wherein the second fluid-filled chamber includes:

a first barrier layer; and a second barrier layer cooperating with the first barrier layer to define an interior void, the interior void including a perimeter region bounding a web area, the web area bounding a central region.

12. The bladder assembly of claim 11, wherein the at least two arcs are in fluid communication with the perimeter region and the central region of the first fluid-filled chamber.

13. The bladder assembly of claim 12, wherein the at least two arcs are concentric with one another.

14. The bladder assembly of claim 11, wherein the perimeter region of the first fluid-filled chamber surrounds the central region of the first fluid-filled chamber and the at least two arcs.

15. The bladder assembly of claim 11, wherein the second fluid-filled chamber further includes a pair of medial lobes, a pair of lateral lobes and a posterior lobe fluidly connecting the pair of medial lobes to the pair of lateral lobes.

16. The bladder assembly of claim 15, wherein the one of the pair of medial lobes of the second fluid-filled chamber is longer than the other of the pair of medial lobes of the second fluid-filled chamber, and wherein one of the pair of lateral lobes of the second fluid-filled chamber is longer than the other of the pair of lateral lobes of the second fluid-filled chamber.

17. The bladder assembly of claim 15, wherein the pair of lateral lobes of the second fluid-filled chamber extend towards the first fluid-filled chamber to a greater extent than the pair of medial lobes.

18. An article of footwear incorporating the bladder assembly of claim 11.

* * * * *